US005344309A

United States Patent [19]

Phare

[11] Patent Number: 5,344,309

[45] Date of Patent: Sep. 6, 1994

[54] CANDLE LIGHTING AND EXTINGUISHING DEVICE

[76] Inventor: Stephen G. Phare, 929 Cox St. P.O. Box 448, Quinnesec, Mich. 49876

[21] Appl. No.: 99,466

[22] Filed: Jul. 30, 1993

[51] Int. Cl.[5] ..... F23Q 25/00

[52] U.S. Cl. ..... 431/145; 431/289

[58] Field of Search ..... 431/145, 144, 269, 33, 431/288, 289

[56] References Cited

U.S. PATENT DOCUMENTS

| | | | |
|---|---|---|---|
| 209,955 | 11/1878 | Brandon | 431/145 |
| 225,350 | 3/1880 | Dallery | 431/145 |
| 240,407 | 4/1881 | Greene | 431/145 |
| 717,186 | 12/1902 | Galipeau | 431/145 |
| 717,186 | 12/1902 | Galipeau . | |
| 1,235,465 | 7/1917 | Hage | 431/144 |
| 1,425,080 | 8/1922 | Cullen | 431/144 |
| 1,941,072 | 12/1933 | Benziger | 431/145 |
| 2,158,744 | 5/1939 | Cormier | 431/145 |
| 2,489,620 | 11/1949 | Cartwright | 431/142 X |
| 2,710,533 | 6/1955 | Fischer et al. | 431/142 X |
| 2,785,556 | 3/1957 | Smith | 431/145 |
| 2,890,515 | 6/1959 | Coolet | 431/142 X |
| 3,399,812 | 9/1968 | Walker | 431/145 X |
| 3,905,750 | 9/1975 | Sell | 431/142 |
| 3,907,490 | 9/1975 | Schaller | 431/344 X |
| 3,985,492 | 10/1976 | Nunemaker | 431/144 |

FOREIGN PATENT DOCUMENTS

| | | | |
|---|---|---|---|
| 1083197 | 3/1959 | Fed. Rep. of Germany | 431/145 |
| 3906148 | 7/1989 | Fed. Rep. of Germany | 431/144 |

*Primary Examiner*—Carl D. Price
*Attorney, Agent, or Firm*—E. Michael Combs

[57] ABSTRACT

An elongate tubular shaft includes a conduit directed therethrough extending from a first end of the shaft to a second end, with the second end of the shaft having a pneumatic generating device such as a squeeze bulb directing air through the conduit into a second arm extending from the first end of the shaft, wherein the second arm includes a second arm hood to be positioned over an associated candle for its snuffing. A first arm oriented diametrically opposed relative to the second arm includes a wick member having a fuel impregnated component therewithin permitting lighting of candles by the wick.

1 Claim, 4 Drawing Sheets

CANDLE LIGHTING AND EXTINGUISHING DEVICE

BACKGROUND OF THE INVENTION

1. Field of the Invention

The field of invention relates to candle lighting and extinguishing structure, and more particularly pertains to a new and improved candle lighting and extinguishing device wherein the same is directed to the selective lighting and extinguishing of candles.

2. Description of the Prior Art

A candle lighting and extinguishing structure is indicated in the prior art such as set forth in U.S. Pat. No. 3,985,492 having a plate with a first end for securement of a match thereto, and a second end having a housing to snuff a candle.

The instant invention attempts to overcome deficiencies of the prior art by employing lighting and extinguishing structure from a same end of an elongate shaft and to employ not a snuffing structure but a pneumatic discharge against the burning candle to effect its extinguishment.

SUMMARY OF THE INVENTION

In view of the foregoing disadvantages inherent in the known types of candle lighting and extinguishing devices now present in the prior art, the present invention provides a candle lighting and extinguishing device wherein the same is directed to the selective lighting and extinguishing of candles employing respectively a wick and a pneumatic means. As such, the general purpose of the present invention, which will be described subsequently in greater detail, is to provide a new and improved candle lighting and extinguishing device which has all the advantages of the prior art candle lighting and extinguishing devices and none of the disadvantages.

To attain this, the present invention provides an elongate tubular shaft including a conduit directed therethrough extending from a first end of the shaft to a second end, with the second end of the shaft having a pneumatic generating device such as a squeeze bulb directing air through the conduit into a second arm extending from the first end of the shaft, wherein the second arm includes a second arm hood to be positioned over an associated candle for its snuffing. A first arm oriented diametrically opposed relative to the second arm includes a wick member having a fuel impregnated component therewithin permitting lighting of candles by the wick.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved candle lighting and extinguishing device which has all the advantages of the prior art candle lighting and extinguishing devices and none of the disadvantages.

It is another object of the present invention to provide a new and improved candle lighting and extinguishing device which may be easily and efficiently manufactured and marketed.

It is a further object of the present invention to provide a new and improved candle lighting and extinguishing device which is of a durable and reliable construction.

An even further object of the present invention is to provide a new and improved candle lighting and extinguishing device which is susceptible of a low cost of manufacture with regard to both materials and labor, and which accordingly is then susceptible of low prices of sale to the consuming public, thereby making such candle lighting and extinguishing devices economically available to the buying public.

Still yet another object of the present invention is to provide a new and improved candle lighting and extinguishing device which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
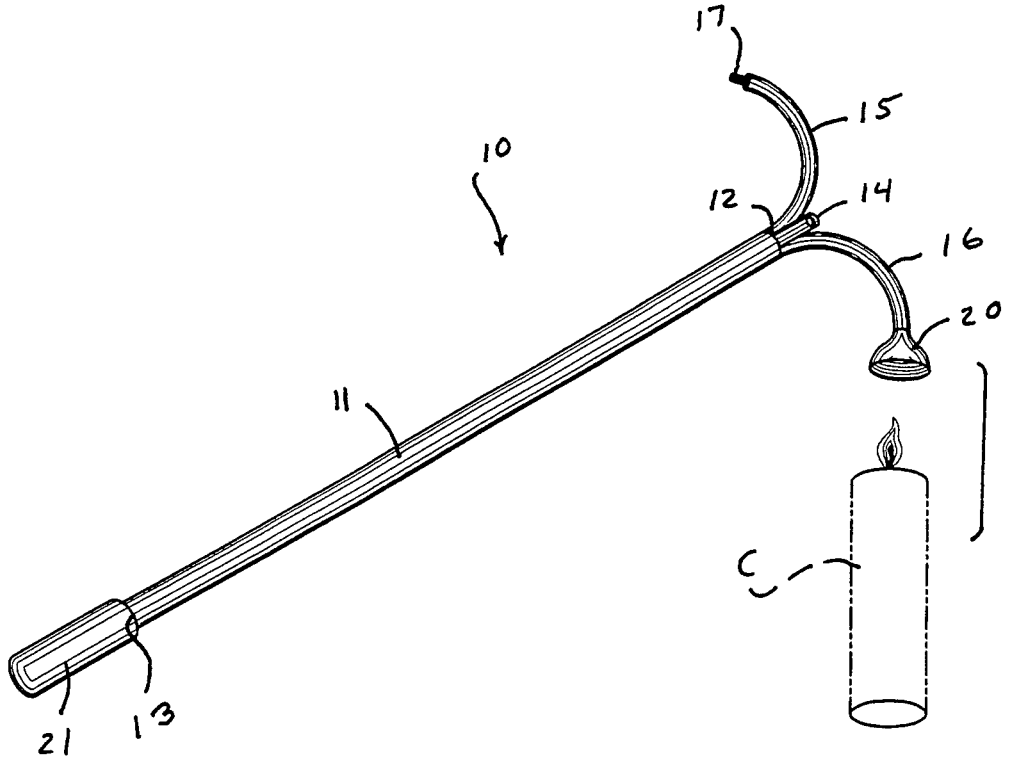
FIG. 1 is an isometric illustration of the invention.
Figure 2:
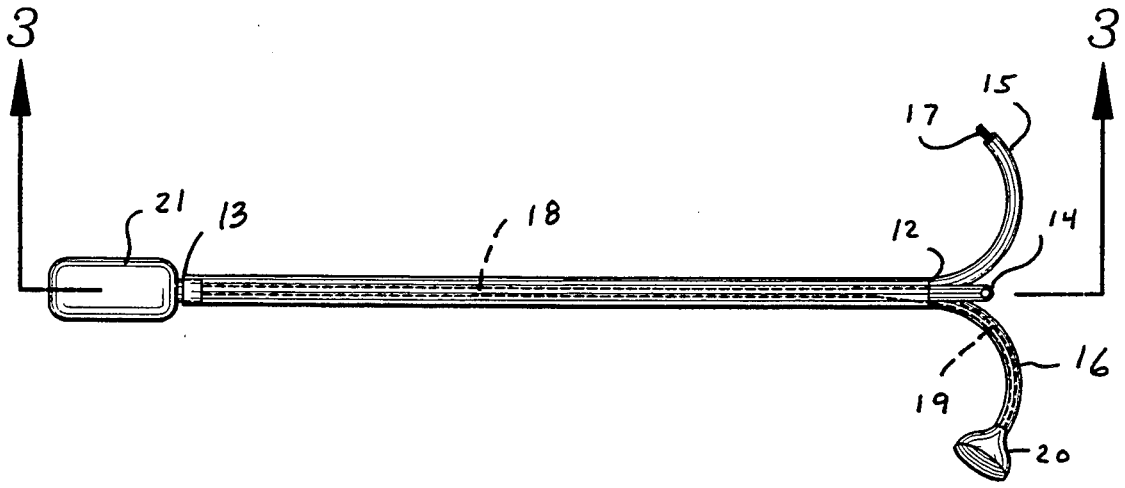
FIG. 2 is an orthographic view of the invention.
Figure 3:
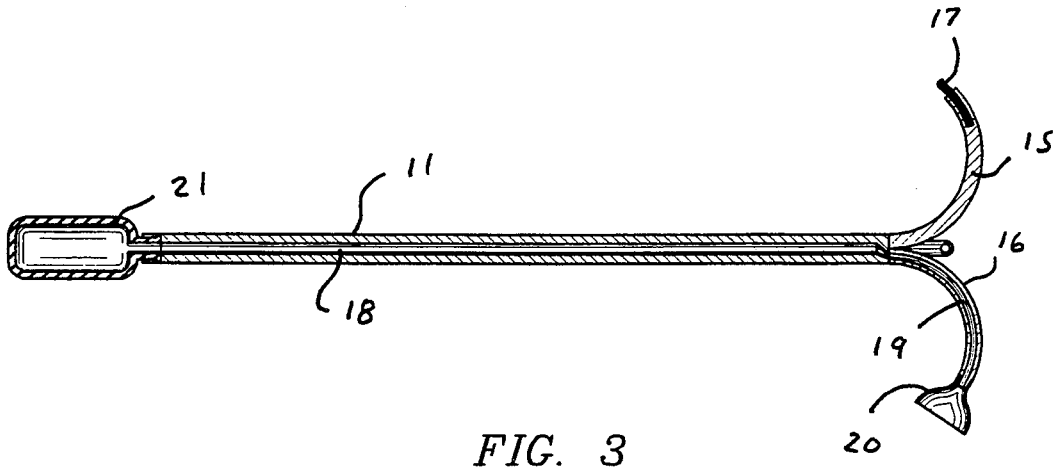
FIG. 3 is an orthographic view, taken along the lines 3—3 of FIG. 2 in the direction indicated by the arrows.

With reference now to the drawings, and in particular to FIGS. 1 to 9 thereof, a new and improved candle lighting and extinguishing device embodying the principles and concepts of the present invention and generally designated by the reference numerals 10 and 10*a* will be described.

More specifically, the candle lighting and extinguishing device 10 of the instant invention essentially comprises an elongate handle shaft 11 having a first end 12 spaced from a second end 13. A support flange 14 extends coaxially of the shaft 11 beyond the first end 12, having a support flange bore permitting support of the organization upon various support structures such as a nail, a peg, and the like. Respective first and second tubular arms 15 and 16 project laterally and radially beyond the first end 12, with the first and second tubular arms 15 and 16 diametrically opposed relative to one another from the first end 12. The support flange 14 bisects a spacing between the first and second arms for balancing of the structure when supported, in a manner as indicated in above. A fuel impregnated wick 17 having impregnated fuel such as wax and the like is slidably received within the first tubular arm 15 to provide ease of lighting of candles "C" prior or subsequent to their extinguishment. A shaft conduit 18 is directed coextensively through the shaft 11 from the first end to the second end, with the shaft conduit 18 in pneumatic communication with a second arm conduit 19 directed coextensively through the second arm 16. A hood 20 is mounted to the outermost distal end of the second arm 16, with the shaft conduit 18 medially directed through the hood 20 as the hood 20 is positioned over a candle flame to receive a burst of air from a flexible bellows 21 mounted to the second end 13 to enhance snuffing of the candle.

Figure 4:
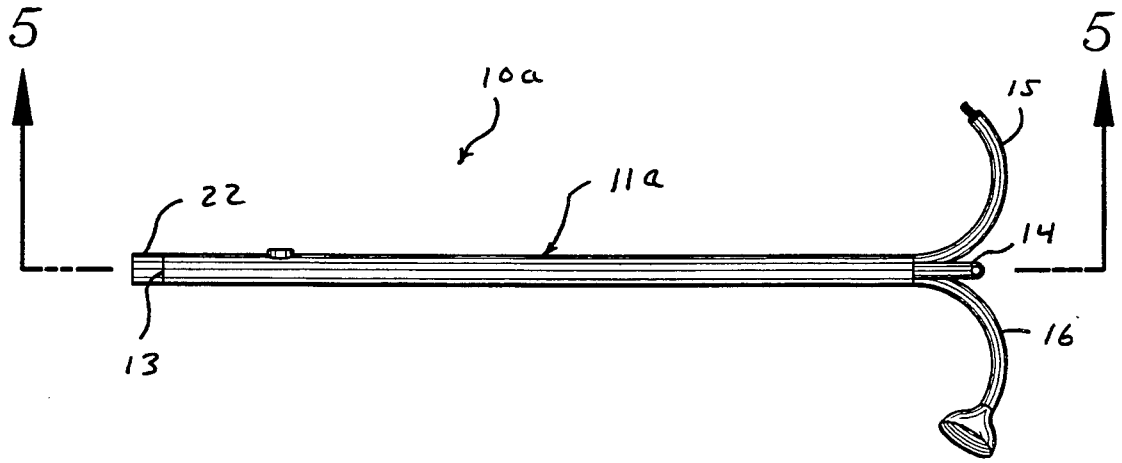
FIG. 4 is an orthographic view of a modified aspect of the invention.
Figure 5:
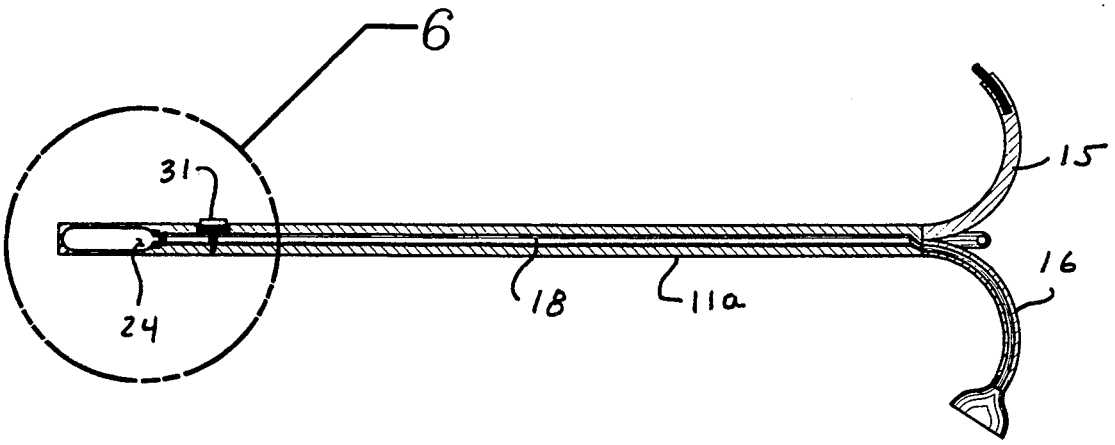
FIG. 5 is an orthographic view, taken along the lines 5—5 of FIG. 4 in the direction indicated by the arrows.
Figure 6:
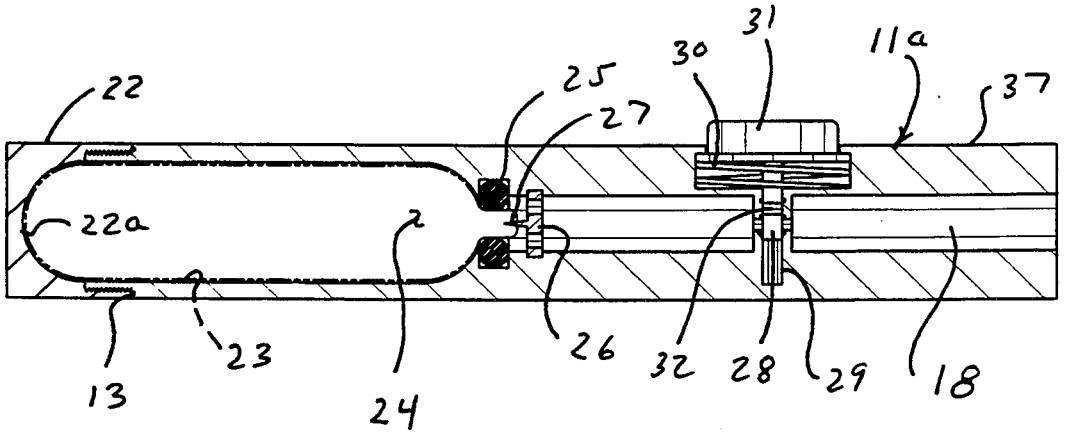
FIG. 6 is an enlarged orthographic view of section 6 as set forth in FIG. 5.

The device 10*a*, as initially indicated in FIG. 4, is arranged to include a modified shaft 11*a* such that an end cap 22 is arranged for threaded securement onto the shaft second end 13 to provide for a cap socket 22*a* in facing relationship relative to a gas cylinder receiving cavity 24 directed into the shaft 11 from its second end 13 to secure a gas cylinder 23. The gas cylinder 23 has its gas cylinder neck received within and concentrically of a sealing ring 25 for projection into an apertured puncture plate 26 having a spike 27 oriented medially and coaxially of the cavity 24, as well as the gas cylinder 23, to puncture the neck to direct pressurized gas into the shaft conduit 18 through an associated valve rod 28 that is reciprocatably mounted within a valve rod bore 29 that is orthogonally oriented relative to the shaft conduit 18. A return spring 30 mounted within the modified shaft 11*a* is arranged to project a valve rod cap 31 exteriorly of the shaft outer wall 37. The valve rod 28 includes a valve rod port 32 arranged for fluid communication within opposite sides of the conduit 18 when the valve rod 28 is directed into the valve rod bore 29.

Figure 7:
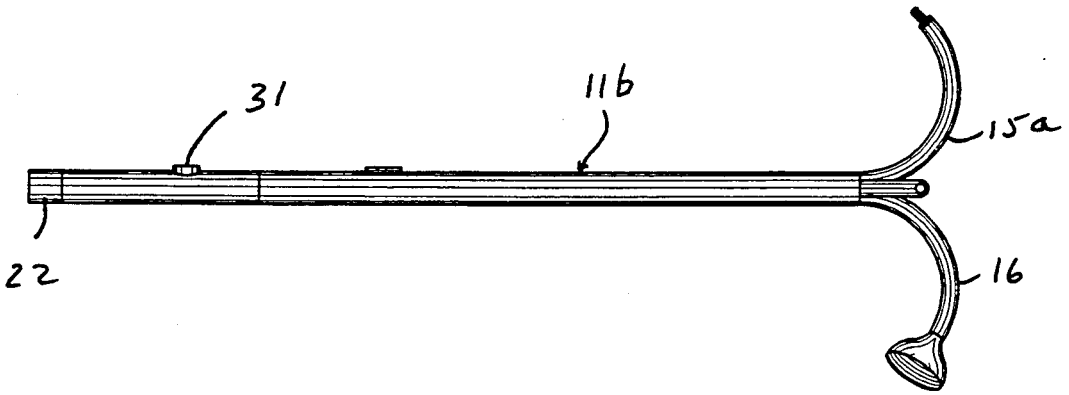
FIG. 7 is an orthographic view of a further modified handle shaft structure.
Figure 8:
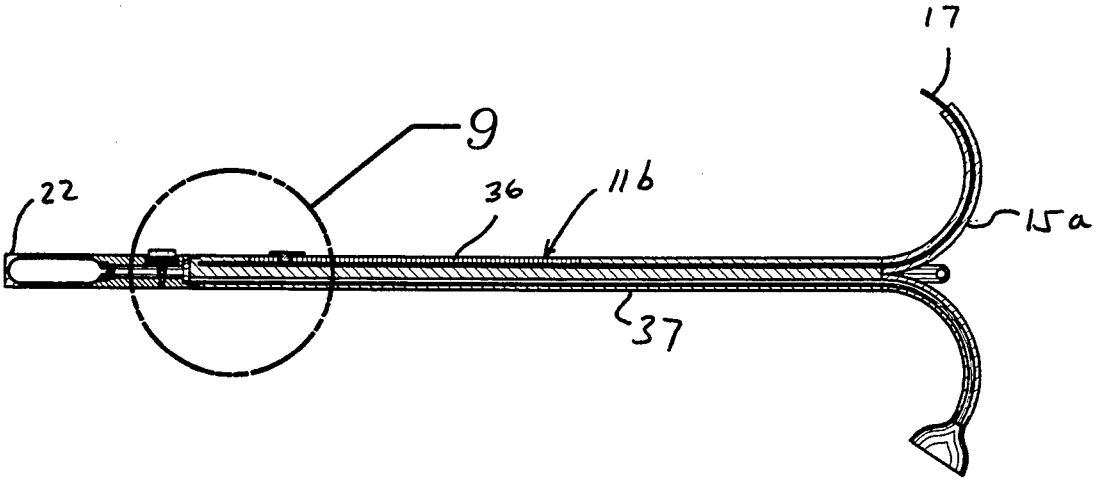
FIG. 8 is an orthographic cross-sectional illustration of the invention, as indicated in FIG. 7.
Figure 9:
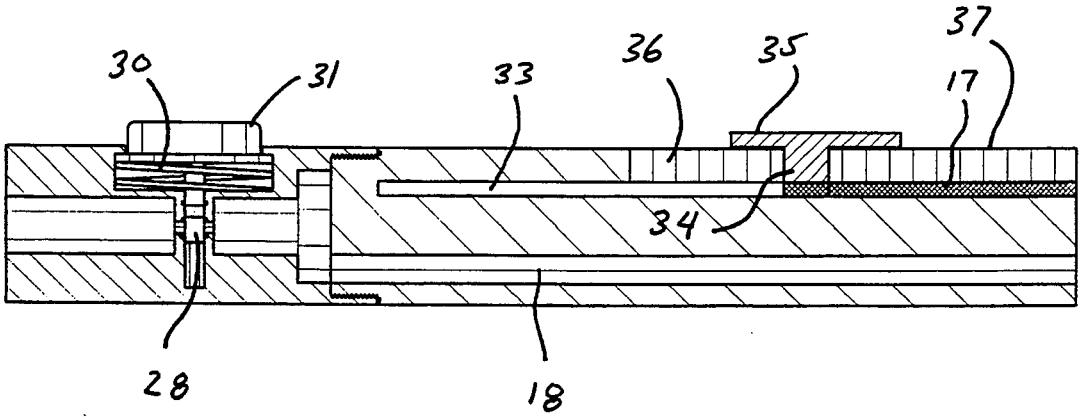
FIG. 9 is an enlarged orthographic view of section 9 as set forth in FIG. 8.

The FIGS. 7–9 indicates a further modified handle shaft 11*a* that is arranged to further include a wick receiving conduit 33 oriented substantially parallel to the shaft conduit 18, such that a wick engaging foot 34 engages the wick 17 within the wick receiving conduit 33, wherein the foot 34 is integral with a slide plate 35 slidably mounted exteriorly of the shaft outer wall 37, with the foot 34 slidably received within a slot 36 in communication with the wick receiving conduit through the shaft outer wall 37 to slidably guide the foot 34 therealong to permit selective projection and retraction of the wick 17 relative to a modified tubular arm 15*a* having a through-extending first tubular arm conduit in communication with the wick receiving conduit 33 to provide for a continuous wick from the wick receiving conduit 33 through the first tubular arm receiving conduit, in a manner as indicated in FIG. 8.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A candle lighting and extinguishing device, comprising, an elongate handle shaft having a first end spaced from a second end, the first end including a first tubular arm and a second tubular arm fixedly mounted to the first end, with the first tubular arm and the second tubular arm projecting exteriorly and laterally of the handle shaft, the first tubular arm including a wick receiving conduit, with the wick receiving conduit including a fuel impregnated wick slidably mounted therewithin, and the second tubular arm having a shaft conduit directed coextensively through the second tubular arm, with the handle shaft including a shaft conduit extending coextensively from the first end through the second end in pneumatic communication with the second arm conduit, with the second arm including an outer distal end spaced from the handle shaft first end, with the outer distal end including a hood, with the second arm conduit extending medially through the hood, and including pneumatic means mounted in adjacency to the second end to direct pressurized air through the shaft conduit and the second arm conduit, and the pneumatic means includes a gas cylinder receiving cavity directed into the handle shaft at the second end, with an end cap threadedly mounted onto the second end, with the end cap including an end cap socket arranged in facing relationship relative to the gas cylinder within the gas cylinder receiving cavity and the socket, with the gas cylinder receiving cavity arranged in pneumatic communication with the shaft conduit, and a sealing ring mounted within the gas cylinder receiving cavity, with the gas cylinder having a gas cylinder neck extending medially through the sealing ring in sealing relationship thereto, and an apertured puncture plate having a spike mounted within the shaft conduit, with the spike projecting medially of the sealing ring for reception within the gas cylinder neck, and a valve rod bore orthogonally intersecting the shaft conduit, with the valve rod bore having a valve rod slidably mounted within the valve rod bore, the valve rod including a valve rod port arranged for sliding and for selective communication between the gas cylinder and the shaft conduit, with the valve rod including a valve rod cap extending exteriorly of the handle shaft, wherein the valve rod cap is arranged for projection within the handle shaft to pneumatically communicate the valve rod port with the gas cylinder and the shaft conduit, and a wick receiving conduit extending through the handle shaft, and the first tubular conduit directed coextensively through the first tubular arm, with the first tubular arm conduit arranged in communication with the wick receiving conduit, with the fuel impregnated wick extending through the first arm conduit and the wick receiving conduit, with a rigid engaging foot engaging the wick, and the handle shaft having a slot directed through a shaft outer wall in communication with the wick receiving conduit, with a slide plate mounted slidingly engaging the shaft outer wall and fixedly mounted to the foot to permit extension and retraction of the wick from the first tubular arm.

* * * * *